United States Patent [19]

Mohrbach

[11] 4,151,622

[45] May 1, 1979

[54] GROOVE CUTTING MACHINE

[75] Inventor: Hans Mohrbach, Rieschweiler-Muhlbach, Fed. Rep. of Germany

[73] Assignee: Ernst Mohrbach KG, Rieschweiler, Fed. Rep. of Germany

[21] Appl. No.: 890,658

[22] Filed: Mar. 20, 1978

[30] Foreign Application Priority Data

Apr. 7, 1977 [DE] Fed. Rep. of Germany ..... 2715648

[51] Int. Cl.[2] ..... A43D 63/00; B06C 11/04; B06D 1/12

[52] U.S. Cl. ..... 12/41.05; 83/425.1; 83/671; 83/693; 83/917; 69/2

[58] Field of Search ..... 12/41.05, 31.5, 27, 12/28, 40; 83/425.1, 425.3, 671, 693, 917; 69/2, 13, 16

[56] References Cited

U.S. PATENT DOCUMENTS

| | | | |
|---|---|---|---|
| 1,247,519 | 11/1917 | Fern | 12/41.05 |
| 1,298,859 | 3/1919 | Schoenky | 12/41.05 |
| 1,856,433 | 5/1932 | Schillo | 83/671 |
| 1,861,913 | 6/1932 | Gannon et al. | 83/671 |
| 2,230,383 | 2/1941 | Monfils | 12/41.05 |

*Primary Examiner*—Patrick D. Lawson
*Attorney, Agent, or Firm*—Frank L. Durr; Orville N. Greene

[57] ABSTRACT

To eliminate the noisy milling machines for cutting grooves in articulation pieces of innersoles, a machine is provided which comprises a series of pairs of forwarding rollers, one of the rollers of the first few pairs of rollers has a double knife formed on at least a part of its circumference so that a piece passing between such a pair has two longitudinal cuts formed thereon which are to become the side walls of the groove; a transverse skinning knife is pivotally mounted so as to be moveable into and out of the path of this piece as it passes a subsequent pair of rollers, this knife has the width of the groove and is pivoted into the path of the piece to remove the material between the longitudinal cuts. Preferably, a bracket device is associated with the skinning knife to maintain the straight path of the piece as the skinning knife works on it.

2 Claims, 5 Drawing Figures

GROOVE CUTTING MACHINE

The invention relates to a groove cutting machine for the production of grooves for the insertion of steel springs in the joint pieces or innersoles for the production of shoes. Up until now, these grooves have been reamed out with high speed milling machines. These machines are especially loud and if the tool be dull exceptionally loud, so that their application in the normal factory course is not possible, they must be installed and operated in separate and/or closed rooms. If one wants to reduce the noise level to a tolerable amount for the operating personnel, the speed of rotation must be decreased which results in a proportional decrease in the through-put efficiency.

It has, accordingly, already been sought to replace the milling machines with cutting tools with U-form blade structure. However, these cutting tools become very dull, especially in their corner areas, so that a neat cut in the material of the joint piece or the innersole cannot be obtained. The rigidity which such a work tool must have, cannot be attained at this point. Hence, it follows that already after a proportionately few working transactions, unclean cuts are obtained.

This invention is based on the problem of developing a groove cutting tool that gives at least as clean a cut as a high speed milling machine, which however operates essentially quietly and which has the required tool life and also permits a sufficiently high through-put.

The invention solves this problem through a groove cutting machine wherein a double knife in the shape of an arc of a circle is formed on the circumference of a roll which double knife can form cuts which provide the side boundaries of the groove and wherein a transversely directed peeling knife, corresponding to the breadth of the groove, is provided to move up and down in rhythm to finish the cutting of the groove.

The knife arrangement is advantageously combined with a roller means which imparts a satisfactory thrust to the work piece, be it a joint piece or a complete innersole.

With the machine of the invention, an exceptionally clean cut is guaranteed so that the groove results in side walls that are absolutely smooth. Through the initial formation of the side boundaries of the groove, the conditions for the subsequent removal of the material for the formation of the groove can be cut out cleanly. The transversely directed skinning knife can, if it is a question, for example, of a joint piece, be drawn through to the end of the piece. When whole innersoles are treated, the knife is withdrawn after a predetermined time, so that similarly to its entrance in the groove, a clean outlet results.

Further features of the invention and particularities which result in advantages of the same, will be apparent from the following description of an embodiment of the machine made according to the invention, shown schematially and by way of example, in the accompanying drawing.

Figure 1:
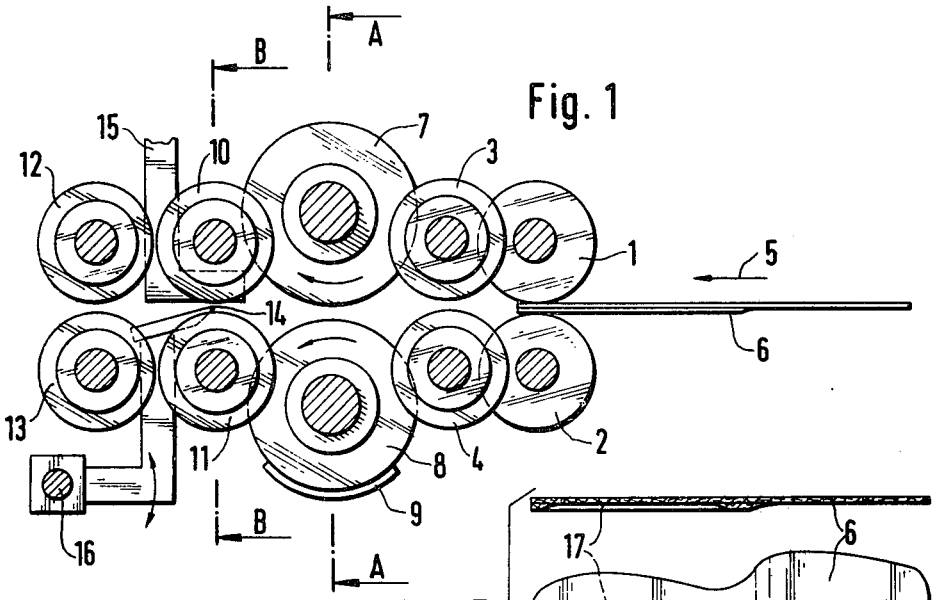
FIG. 1 is a side view of the essential functioning parts of the machine.
Figure 5:
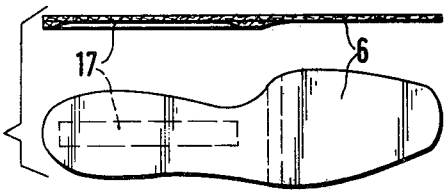
Figure 2:
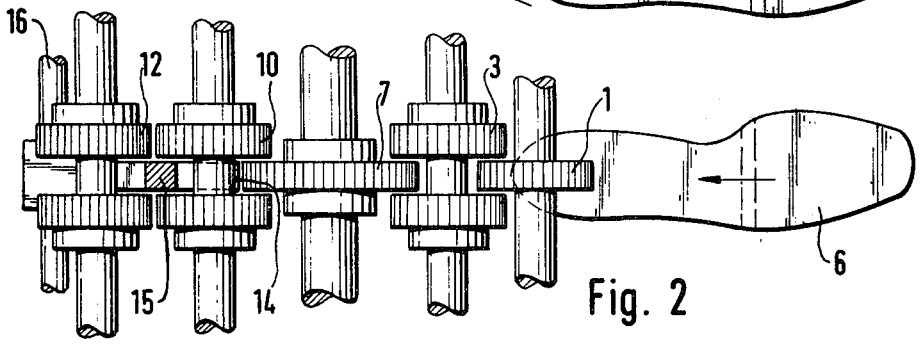
FIG. 2 is a plan view of these parts.
Figure 4:
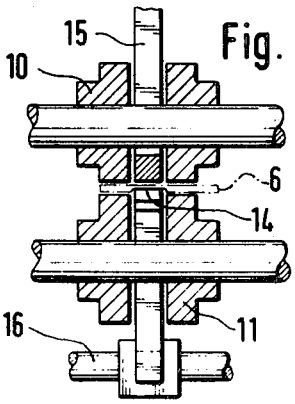
FIG. 4 is a sectional view taken on line B—B of FIG. 1.
Figure 3:
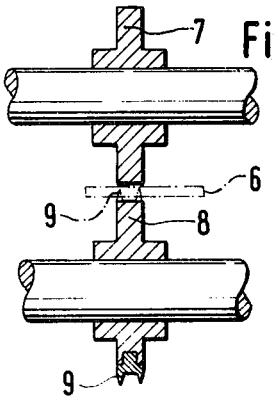
FIG. 3 is a sectional view taken on line A—A of FIG. 1.

FIG. 5 reproduces a section and plan view of a finished innersole.

The machine has in its essentials, a roller arrangement by which first rollers 1 and 2, as well as twin rollers 3 and 4, serve to lead-in the blanks to be worked on in the direction of the arrow 5. For example, the innersole 6 is shown as such a blank. Rollers 7 and 8 follow rollers 3 and 4. While the upper roller 7 serves as a guide, the lower roller 8 is equipped with a double knife 9, which by passage of the of the innersole 6 through the machine, produces the two lateral boundary cuts which then form the longitudinal side walls of the produced groove.

After rollers 7 and 8, further twin or double rollers 10,11 and 12,13 follow. In the area of double rollers 10,11 a peeling knife 14 is arranged which operates with an arm bracket 15. The peeling or skinning knife 14 is lifted and lowered in rythm, it being pivotable about an axle 16 so that it peels out from the material of the blank, the material in the area between the longitudinal cuts made by knives 9. This strip can fall downwards.

The direction of rotation of rollers 7 and 8 is indicated by the arrows and the up and down movement of the skinning knife 14 similarly.

FIG. 5 shows an inner sole 6 operated on by the knives 9 and the skinning knife 14 to produce the groove 17 in the joint area of the innersole for the introduction of the joint spring.

Just as with the complete inner sole, a joint or articulation piece can also be worked on in the machine. With them, as a general rule, the groove will be pulled through up to the forward edge of the piece. The feeding of the machine with the blanks to be worked on, as well as the removal of the worked bands, can take place with the usual and known apparatus or apparatus parts.

I claim:

1. A groove cutting machine for the production of grooves for the reception of steel springs in articulation pieces or innersoles for shoes, comprising a series of forwarding pairs of opposed rollers which are rotated to feed the piece therebetween, one roller of one pair following the first pair, having a double knife on at least a portion of its circumference adapted to but the side walls of the groove to be formed in the piece, a transversely directed skinning knife of the breadth of the cut, said knife being pivotally mounted to project into or away from the path of a piece as it passes a pair of rollers subsequent to the rollers with the double knife.

2. A groove cutting machine as claimed in claim 1 comprising bracket means cooperating with said peeling knife to maintain the straight path of the piece as it is being operated on by the skinning knife.

* * * * *